United States Patent [19]

Smillie, III et al.

[11] Patent Number: 4,972,763

[45] Date of Patent: Nov. 27, 1990

[54] IMPACT ABSORBING SHIELD FOR INDUSTRIAL CYLINDER AND METHOD OF USING SAME

[75] Inventors: Charles M. Smillie, III, West Bloomfield; Anthony J. Tomac, Troy, both of Mich.

[73] Assignee: C. M. Smillie & Company, Ferndale, Mich.

[21] Appl. No.: 339,732

[22] Filed: Apr. 18, 1989

[51] Int. Cl.[5] ..... F01B 11/02

[52] U.S. Cl. ..... 92/169.1; 92/169.2; 92/171.1; 109/24; 109/49.5; 109/79; 220/4 R

[58] Field of Search ..... 92/169.1, 169.2, 171.1; 29/453; 89/36.07, 36.08, 36.09, 36.11; 109/78, 79, 81, 24, 495; 220/4 R

[56] References Cited

U.S. PATENT DOCUMENTS

| | | | |
|---|---|---|---|
| 2,380,393 | 7/1945 | Berg | 89/36.08 X |
| 3,044,655 | 7/1962 | Rebikoff | 220/4 R |
| 3,439,885 | 4/1969 | Sackleh | 89/36.11 X |
| 3,490,344 | 1/1970 | Archer et al. | 92/169.1 X |
| 4,036,104 | 7/1977 | Pagano et al. | 89/36.08 |
| 4,073,219 | 2/1978 | Bimba | 92/164 X |
| 4,263,841 | 4/1981 | Bimba | 92/164 X |
| 4,316,404 | 2/1982 | Medlin | 89/36.08 |
| 4,608,912 | 9/1986 | Navarette | 92/169.1 X |
| 4,744,310 | 5/1988 | Moore | 109/49.5 |
| 4,781,101 | 11/1988 | Zevuluni et al. | 109/49.5 X |
| 4,802,404 | 2/1989 | Dirkin et al. | 92/171.1 |
| 4,831,920 | 5/1989 | Cornell | 92/258 |
| 4,884,493 | 12/1989 | Tootle | 92/128 |

*Primary Examiner*—John T. Kwon
*Assistant Examiner*—John E. Ryznic
*Attorney, Agent, or Firm*—Dykema Gossett

[57] ABSTRACT

A shield member is disclosed for protecting a cylinder barrel. In one embodiment, the shield member is received upon the tie rods that secure the head and end plate of the cylinder assembly. This shield member protects the surface of the cylinder barrel from any accidental impact. A channel portion at an inner periphery of the shield member will bow inwardly to absorb the force of any impact that is received on the shield member. The shield member is preferably extruded from urethane and may be cut to the appropriate lengths for a particular cylinder assembly. The shield member may be utilized on any one of the four quadrants of a standard cylinder barrel. That is, if one of the quadrants of the cylinder barrel is not in danger of impact, it is not necessary to have a shield member disposed on that particular quadrant. A second embodiment is disclosed to protect cylinder assemblies that do not use tie rods.

14 Claims, 2 Drawing Sheets

IMPACT ABSORBING SHIELD FOR INDUSTRIAL CYLINDER AND METHOD OF USING SAME

BACKGROUND OF THE INVENTION

The present invention relates to a shield that will protect a cylinder barrel from being damaged due to an impact. More particularly, the present invention discloses a shield that is selectively mounted to absorb the impact of an item that would otherwise damage the cylinder barrel.

Fluid cylinders are used in a variety of industrial environments and may be utilized as hydraulic or pneumatic cylinders in order to transmit power from a pressure fluid to create movement of a piston rod. Also, these cylinders may be utilized as pumps if the piston is driven to move a fluid within the cylinder. Historically, the cylinder barrels have typically been formed of steel.

In modern engineering, there are two conflicting requirements in the design of cylinder barrels. It is important that the cylinder barrel weight be reduced whenever possible. It is an object of most modern engineering situations to reduce the weight of all components and thus there is a very real need to create a cylinder barrel that will weigh as little as possible. However, in reducing the weight of the cylinder barrel either by reducing the thickness of its walls, or by using lighter materials, the strength of the cylinder barrel is correspondingly reduced. The cylinder barrel must be strong enough to resist impact from various members that may accidentally be brought into contact with the cylinder barrel.

Thus, many cylinder barrels have relatively thin walls and are formed from lighter materials. When these cylinder barrels are accidentally impacted by an item, damage will result to the cylinder barrel and the cylinder barrel must usually be discarded.

One solution found in the prior art is to dispose a cylinder barrel within a tube. This solution is costly and usually adds undesirable weight.

Plastic covers for cylinder barrels and cylinder barrels formed of plastic have been known and utilized for various purposes. U.S. Pat. No. 4,671,746 shows a plastic outer covering disposed about the body of a hydraulic hand pump. This plastic covering is used to encapsulate aluminum housing members. However, with a device such as this, the housing cannot be selectively placed only over areas of a cylinder barrel that are exposed to impact. Also, in these types of devices, it is typically difficult to remove the cylinder barrel for any maintenance.

Several prior art devices have used cylinders formed from plastic. U.S. Pat. No. 4,785,721 is an example of such an item. The plastic cylinder results in a less expensive overall cylinder construction. However, plastic cylinders are not typically sufficiently strong to handle the high pressures that are encountered in many industrial cylinder applications. Additionally, these types of plastic cylinders cannot be selectively placed only over the areas of the cylinder barrel that are exposed to impact.

Therefore, it is an object of the present invention to create a cylinder assembly that will on the one hand be of lighter weight and will utilize light weight materials for the cylinder barrel and on the other hand will be sufficiently strong to resist damage from impact.

It is further an object of the present invention to disclose a method of protecting a cylinder barrel from accidental impact with an item.

It is further an object of the present invention to disclose a shield member that may be disposed on standard cylinder barrels in order to provide impact protection for the cylinder barrels.

SUMMARY OF THE INVENTION

This invention discloses a method and apparatus for protecting cylinder barrels. A shield member is disposed on the cylinder barrel over all surfaces that may be subject to impact.

In one embodiment, this shield member has snap on portions that correspond to the tie rods that connect standard cylinders such that the shield is disposed between two adjacent tie rods and will protect the surface of the cylinder barrel intermediate the two tie rods.

In a second embodiment, the shield consists of a plastic jacket with Velcro TM fasteners that wrap around the jacket to secure the jacket to a cylinder barrel.

In a preferred embodiment of the present invention this shield will extend from the head of the cylinder longitudinally along the cylinder barrel to the end plate of the cylinder.

The shield of the present invention consists of a central bridge portion having a channel or undercut portion that will be radially removed from the surface of the cylinder barrel. Abutment faces are disposed on the shield on each side of this channel portion and are in contact with the surface of the cylinder barrel. These abutment faces may be adhesively bonded to the cylinder barrel and the intermediate channel portion will flex radially inwardly to absorb much of the impact from any item that may be accidentally brought into contact with the shield member. In one embodiment, tie rod snap-on portions are formed near the abutment face and will create an interference fit with the tie rods on a standard cylinder assembly to tightly secure the shield member between two adjacent tie rods. Other methods of securing the shield to the tie rods may be acceptable.

The central bridge portion of the shield will extend radially outwardly beyond the extent of both the end plate and the head of the cylinder and thus will absorb the impact of any elongate item that might otherwise contact the head or end plate thus also providing some protection for those members.

In the method of the present invention, this shield may be disposed between any two of the four tie rods commonly used in cylinder assemblies. That is, if only one of the four quadrants of the cylinder barrel is in danger from impact the shield will only be disposed on that particular quadrant. If all four quadrants may be exposed to impact, the shield can be disposed on all four of the quadrants. In one embodiment, the shield will extend from the head all the way to the end plate. However, if the cylinder barrel is unusually long, several spaced shield portions may be utilized instead.

In a preferred embodiment, the shield member of the present invention is made of a resilient synthetic material.

In a most preferred embodiment of the present invention, the shield member is formed of urethane and is extruded into long strips. These long strips are then cut into size to conform to the specific length of the cylinder barrel that the shield will be utilized on.

These and other features of the present invention can be best understood from the following specification and appended drawings of which the following is a brief description thereof.

DETAILED DESCRIPTION OF THE PREFERRED EMBODIMENT

Figure 1:
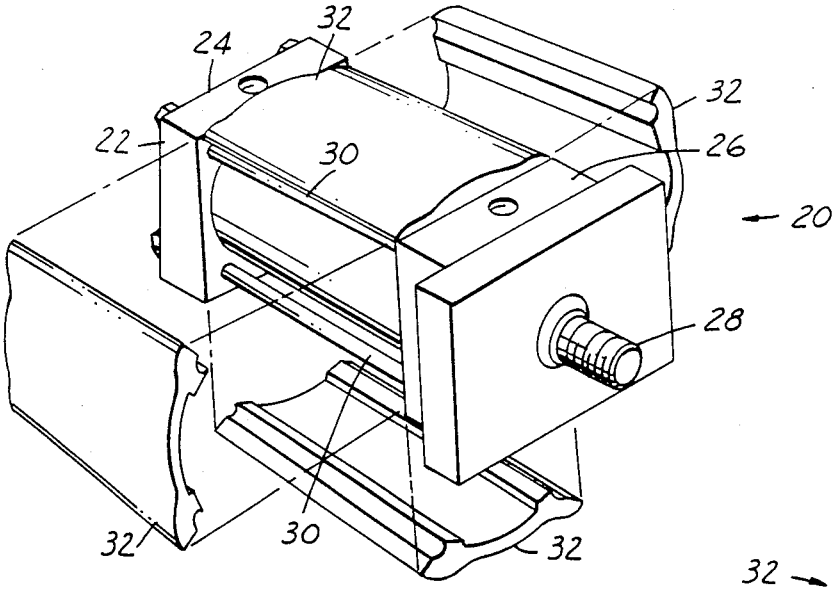
FIG. 1 is a perspective view showing a standard cylinder assembly having a shield member disposed on one of its four quadrants.

A cylinder assembly 20 is illustrated in FIG. 1 and will conform to standard National Fluid Power Association cylinder specifications (NFPA). In this type of standard cylinder assembly 20 there is a cylinder barrel 22 that extends between a head member 24 and an end plate 26. A connection rod 28 extends outwardly of the end plate 26 and is connected to a mechanism that either may be driven by or will drive a piston within cylinder barrel 22. Tie rods 30 are disposed at four corners of the assembly 20 and connect the head 24 to the end plate 26 thus securing cylinder barrel 22 there between. The tie rods 30 are disposed radially outside cylinder barrel 22. A shield member 32 is disposed between two tie rods 30 at a top quadrant of the cylinder barrel 22. Optionally, shield members 32 are illustrated aligned with, and may be disposed on, the other three quadrants of cylinder barrel 22.

Figure 2:
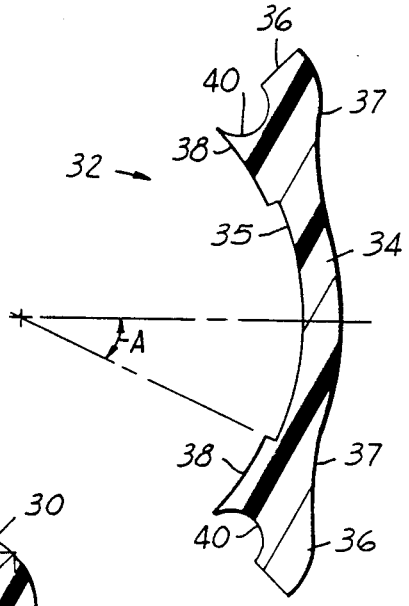
FIG. 2 is a cross-sectional view through a shield member of the present invention.

A cross section of shield member 32 is illustrated in FIG. 2. Shield member 32 has a central bridge portion 34 with a channel or undercut portion 35 formed at an inner peripheral surface thereof. Snap-on portions 36 are formed on both sides of central bridge portion 34. Snap-on portions 36 are connected through a ramped connecting portion 37 to the bridge portion 34. An abutment face 38 is formed on the inner periphery of the snap-on portion 36 and has a curved face at its inner surface. A grip portion 40 is formed at the outer extent of the snap-on portion 36 and will receive tie rods 30 in an interference fit. The extent of channel 35 is defined by an angle A, 25° in a preferred embodiment.

Although grip portions 40 are preferable, other methods of securing shield member 32 to tie rods 30 may be satisfactory.

Figure 3:
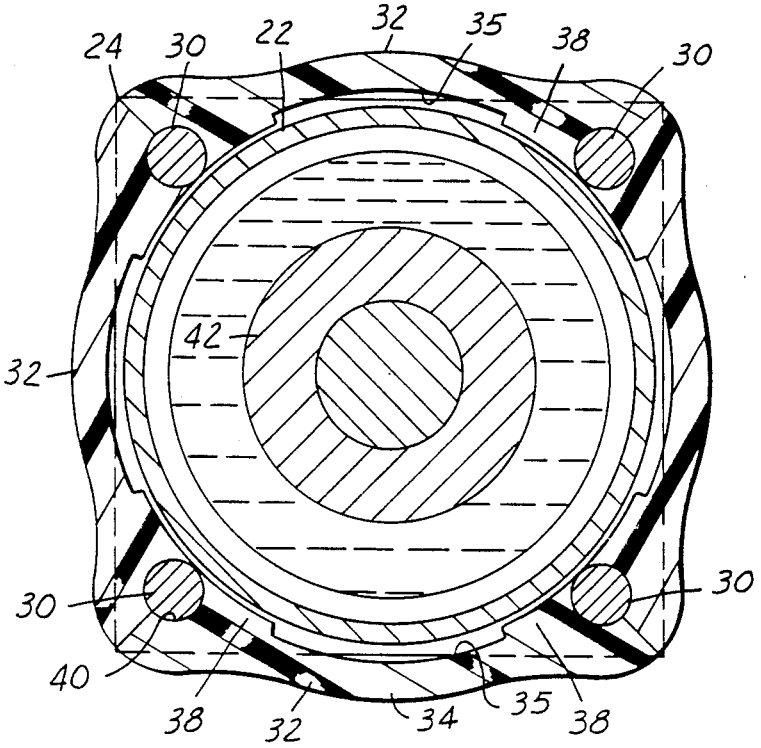
FIG. 3 is a cross-sectional view through a cylinder barrel having four of the shield members of the present invention mounted thereon.

As shown in FIG. 3, cylinder barrel 22 has a piston 42 received therein for movement of fluid. The cylinder barrel 22 can be said to have four quadrants defined as the areas between any two adjacent tie rods 30. Four shield members 32 are illustrated as being disposed between tie rods 30 thus protecting all four quadrants of cylinder 22.

It is to be understood that if only a particular quadrant of the cylinder is in need of protection, the shield need only be disposed on that particular quadrant. This results in great savings of material cost and weight. Of course, if two or more of the quadrants are in need of protection, the shield will be placed on those quadrants also.

Abutment faces 38 are shown in contact with the outer periphery of cylinder barrel 32. Channel 35 is spaced from the outer periphery of the barrel 22. In a preferred embodiment, this spacing is 1/16 of an inch. The abutment face 38 is preferably attached to the cylinder barrel 22 by an adhesive two-faced strip. A suitable two-face strip is available from 3M Corporation.

Bolt grip portions 40 that are attached to tie rods 30 have an interference fit with the tie rods 30 and that alone could secure the shield 32. That is, the two-faced strip may not be necessary. The circumferential extent of shield 32 may be greater than the circumferential distance between tie rods 30. This will result in shields 32 being wedged between tie rods 30, thus securing them.

It is also clear from FIG. 3 that the outer radial extent of bridge portion 34 extends radially outwardly to a greater extent than the head 24 or the end plate 26. This will ensure that the shield member will absorb the impact of any elongate item that may fall upon the cylinder assembly 20 and will provide some protection to the head 24 and end plate 26.

Figure 4:
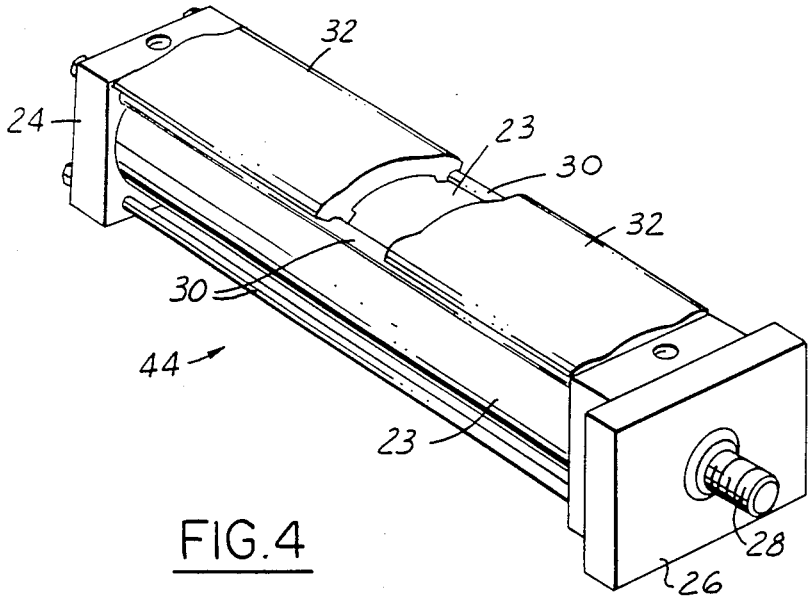
FIG. 4 is a perspective view showing a standard cylinder assembly having several distinct members mounted thereon.

With reference to FIG. 4, the use of the shield 32 of the present invention with an unusually long cylinder assembly 44 will be explained. When an unusually long cylinder barrel 23 is encountered, it may be preferable to have a series of members 32 disposed to protect its outer surface. That is, it is not necessary to protect the entire length of the cylinder barrel 23 in an unusually long cylinder assembly 44. If the various shields 32 that are utilized are spaced by a amount small enough to ensure that no items will be able to hit cylinder barrel 23 of cylinder assembly 44 without contacting a shield member 32, then this should be sufficient. This spacing of several shields 32 will result in lower material costs and overall weight than if the entire length of cylinder barrel 23 were covered.

Figure 5:
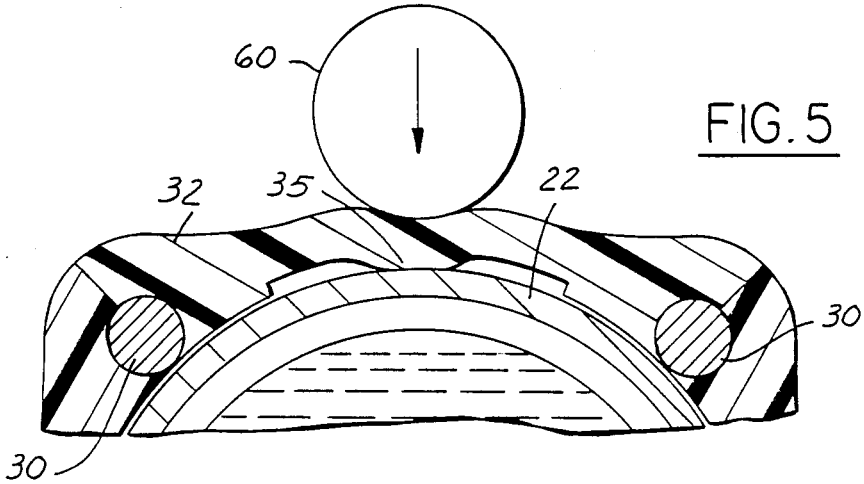
FIG. 5 illustrates the flexing of the shield member when impacted by an item.

With reference to FIG. 5, the impacting of an item 60 on shield member 32 will be explained. As shown in FIG. 5, when item 60 impacts the outer periphery of shield 32, channel 35 will tend to bow inwardly, thus absorbing a great deal of the impact. If the impact is great enough, channel 35 may actually be brought into contact with cylinder barrel 22. However, channel 35 will tend to absorb enough of the impact that the resulting force from the channel 35 contacting the cylinder barrel 22 should not be great enough to damage cylinder barrel 22.

Tie rods 30 also aid in absorbing a portion of the impact. Any force in a horizontal direction, defined in the drawing as oriented in FIG. 5, will be directed into tie rods 30. Tie rods 30 will absorb this force thus protecting cylinder barrel 22.

The shield member 32 of the present invention is preferably an extruded urethane item that is extruded in long strips. In one embodiment, it is extruded in twelve foot lengths. These strips of shield member material can be cut to the proper length for any particular cylinder environment, either by the manufacturer or the final consumer. In addition, the shield members 32 are of the proper circumferential size to fit between the tie rods 30 on any standard NFPA cylinder. One foot of the extruded shield material will add ⅓ pound of weight to the total weight of a cylinder assembly.

In addition, the shield 32 will provide some additional cylinder strength to resist internal pressures such as burst pressure. The cylinder assembly 20 can still be disassembled for repair since the shield is not glued to tie rods 30.

Figure 6:
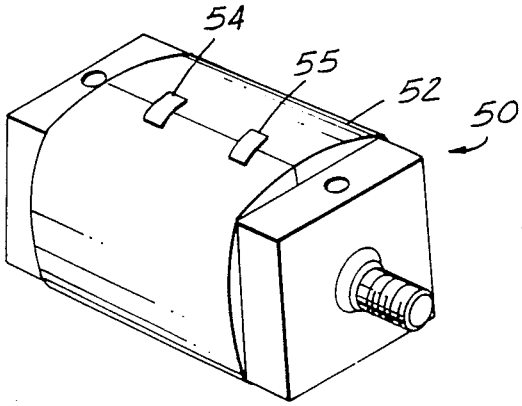
FIG. 6 is a perspective view of a second embodiment of the present invention.

FIG. 6 illustrates a second embodiment of the present invention. In FIG. 6, a cylinder assembly 50 is formed without tie rods. A shield 20, basically a plastic jacket, is wrapped around the cylinder barrel of the cylinder assembly 50. Adhesive strips, such as Velcro TM strips secure the jacket to itself about the cylinder. The jacket of this embodiment has a cross-section similar to that of the first embodiment and including a channel 35.

This invention is envisioned for use on all cylinder applications, and in particular for fixture, clamp, shuttle and stop conveyor cylinders and all other common applications. The invention is especially useful in mobile applications, such as robot arms or operator-carried devices such as hand tools.

The shields can be color coded to aid in identifying a particular cylinder. For instance, four shields of a first color might identify a hydraulic pump cylinder, while two shields, each of distinct colors could identify a hydraulic motor cylinder.

A working embodiment of the present invention has been disclosed, however, further modifications of the invention may be made without departing from the scope and content of the invention, which can be better understood when considered in light of the appended claims.

We claim:

1. A method of protecting a cylinder assembly having a cylinder barrel extending between a head and an end plate, and tie rods connecting the end plate and the head where the tie rods are radially outside the cylinder barrel comprising the steps of:

(a) determining a surface area to be protected;

(b) disposing a shield member over the area to be protected and removably securing the shield member to the tie rods.

2. A method as recited in claim 1, and wherein said shield member is also secured to the cylinder barrel.

3. A method as recited in claim 1, and wherein the shield member is formed of an extruded urethane material.

4. A method as recited in claim 1, and wherein the shield member has a channel portion at an inner periphery thereof that will bow to absorb the impact of any item that may be brought into contact with the shield member.

5. A method for protecting a cylinder comprising the steps of:

(a) determining a surface area to be protected on a cylinder barrel;

(b) disposing a shield member on the area to be protected, said shield member being secured by Velcro TM strips to said cylinder barrel.

6. A shield member for use on cylinder assemblies comprising;

a one-piece urethane extruded member extending along a circumferential extent and having an inner periphery and an outer periphery, with a central bridge portion and two snap-on portions formed on each circumferential side of said bridge portion, said snap-on portions having grip portions to receive tie bolts, said snap-on portions having abutment faces at their inner periphery, said bridge portion having a channel surface at its inner periphery, wherein said channel surface does not extend radially inwardly to the same extent as said abutment faces.

7. A cylinder assembly comprising:

a cylinder barrel, a head member, an end plate, said cylinder barrel being disposed between said head and said end plate, tie rods connecting said head to said end plate;

a shield member being removably received on said tie rods to protect the area of said cylinder barrel between said tie rods.

8. A cylinder assembly as recited in claim 7, and wherein there are four of said tie rods spaced equal distance apart.

9. A cylinder assembly as recited in claim 7, and wherein said shield member has a central bridge portion and two snap-on portions circumferentially spaced from said central bridge portion, said snap-on portions having abutment faces at an inner periphery of said shield member, said abutment faces being in contact with said cylinder barrel.

10. A cylinder assembly as recited in claim 9, and wherein said abutment faces are attached to said cylinder barrel by an adhesive.

11. A cylinder assembly as recited in claim 10, and wherein said adhesive is a two-face adhesive strip.

12. A cylinder assembly as recited in claim 9, and wherein said bridge portion has a channel portion formed at an inner periphery thereof, said channel portion not extending radially inwardly to contact said cylinder barrel, but being spaced from said cylinder barrel, said channel flexing inwardly when an item is impacted into said shield, said flexing of said channel absorbing a portion of the impact of any item that may impact said shield, the remainder of the impact being absorbed by said tie rods.

13. A cylinder assembly as recited in claim 7, and wherein said cylinder barrel is formed of aluminum.

14. A cylinder assembly comprising:

a head member, an end plate, and a cylinder barrel disposed between said head member and said end plate, four tie rods disposed radially outwardly of said cylinder barrel and connecting said head member and said end plate such that said cylinder barrel is retained between said head member and said end plate;

a shield member received on at least two of said tie rods to protect the area on said cylinder barrel between at least two tie rods, said shield member comprising a central bridge portion and two snap-on portions spaced circumferentially from said central bridge portion, said snap-on portions having abutment faces at their inner periphery in contact with said cylinder barrel and being secured to said cylinder barrel by a two-face strip adhesive, said central bridge portion having a channel portion formed at an inner periphery thereof spaced from said cylinder barrel; and said snap-on portions having gripping portions configured to be received in an interference fit on said tie rods to further secure said at least one shield member.

* * * * *